US012042739B2

(12) United States Patent
Hatamian et al.

(10) Patent No.: US 12,042,739 B2
(45) Date of Patent: Jul. 23, 2024

(54) COLLABORATIVE IMAGE SYNTHESIS FROM THREE DIMENSIONAL CUBES

(71) Applicant: 22nd Solutions, LLC, Newport Beach, CA (US)

(72) Inventors: Mehdi Hatamian, Mission Viejo, CA (US); David Garrett, Tustin, CA (US); Marcy Garrett, Tustin, CA (US)

(73) Assignee: 22nd Solutions, LLC, Newport Beach, CA (US)

( * ) Notice: Subject to any disclaimer, the term of this patent is extended or adjusted under 35 U.S.C. 154(b) by 152 days.

(21) Appl. No.: 17/734,085

(22) Filed: May 1, 2022

(65) Prior Publication Data

US 2022/0347554 A1 Nov. 3, 2022

Related U.S. Application Data

(60) Provisional application No. 63/183,495, filed on May 3, 2021.

(51) Int. Cl.
*A63F 9/24* (2006.01)
*A63F 9/06* (2006.01)
*A63F 9/08* (2006.01)

(52) U.S. Cl.
CPC ..... *A63F 9/0612* (2013.01); *A63F 9/0826* (2013.01); *A63F 9/24* (2013.01); *A63F 2009/246* (2013.01)

(58) Field of Classification Search
CPC ..... A63F 9/0612; A63F 9/0826; A63F 9/24; A63F 2009/246
USPC ..... 463/9
See application file for complete search history.

(56) References Cited

U.S. PATENT DOCUMENTS

| | | | | |
|---|---|---|---|---|
| 5,785,319 | A * | 7/1998 | Frauhiger | A63F 9/1204 273/157 R |
| 6,196,544 | B1 * | 3/2001 | Rachofsky | A63F 9/12 273/157 R |
| 6,422,560 | B1 * | 7/2002 | Harbaugh | A63F 9/1204 273/153 S |
| 8,628,087 | B2 * | 1/2014 | Knowlton | G06T 11/60 273/153 R |
| 9,919,224 | B2 * | 3/2018 | Mott | A63F 13/822 |
| 10,143,913 | B2 * | 12/2018 | Baddoo | A63F 13/352 |

* cited by examiner

*Primary Examiner* — Allen Chan
(74) *Attorney, Agent, or Firm* — Makoui Law, PC; Ali Makoui

(57) ABSTRACT

A method of gradually revealing an image using cube puzzles is provided. A first image is divided into a plurality of blocks. Each block can have one or more arbitrary colors. A second image is then generated from the first image where each block of the second image corresponds to one or more blocks of the first image. The blocks of the second image are unicolor blocks with colors that are selected from one of the six colors of a cube puzzle. Groups of adjacent blocks of the second image with the same number of rows and columns as the sides of the cube puzzles are assigned to participants to match to the color of the blocks on the sides of their cube puzzles. Once each participant matches the colors of an assigned region on a side of the corresponding cube puzzle, the matched region is reveled to all participants.

20 Claims, 8 Drawing Sheets

COLLABORATIVE IMAGE SYNTHESIS FROM THREE DIMENSIONAL CUBES

CLAIM OF BENEFIT TO PRIOR APPLICATIONS

This application claims the benefit of U.S. Provisional Patent Application Ser. No. 63/183,495, filed on May 3, 2021. The contents of U.S. Provisional Patent Application 63/183,495 are hereby incorporated by reference.

BACKGROUND

Cube puzzles are devices that typically have six faces, each face having nine blocks. The blocks may have one of six colors. There may be nine blocks of each color. The positions of the blocks may be changed on each face of the cube puzzle. A block may be moved from one face to another. The cube puzzles may be used to match particular patterns on one or more faces.

The original cube puzzles were pure mechanical devices. In recent years, smart cube puzzles with processor and/or wireless transceivers have been made that may provide hints or feedback to a person using the cubes to facilitate matching a particular pattern or to teach different skills of solving the cube puzzle.

BRIEF DESCRIPTION OF THE DRAWINGS

The various embodiments of the present collaborative image synthesis from three dimensional cubes now will be discussed in detail with an emphasis on highlighting the advantageous features. These embodiments depict the novel and non-obvious collaborative image synthesis from three dimensional cubes shown in the accompanying drawings, which are for illustrative purposes only. These drawings include the following figures, in which like numerals indicate like parts.

DETAILED DESCRIPTION

Figure 1:
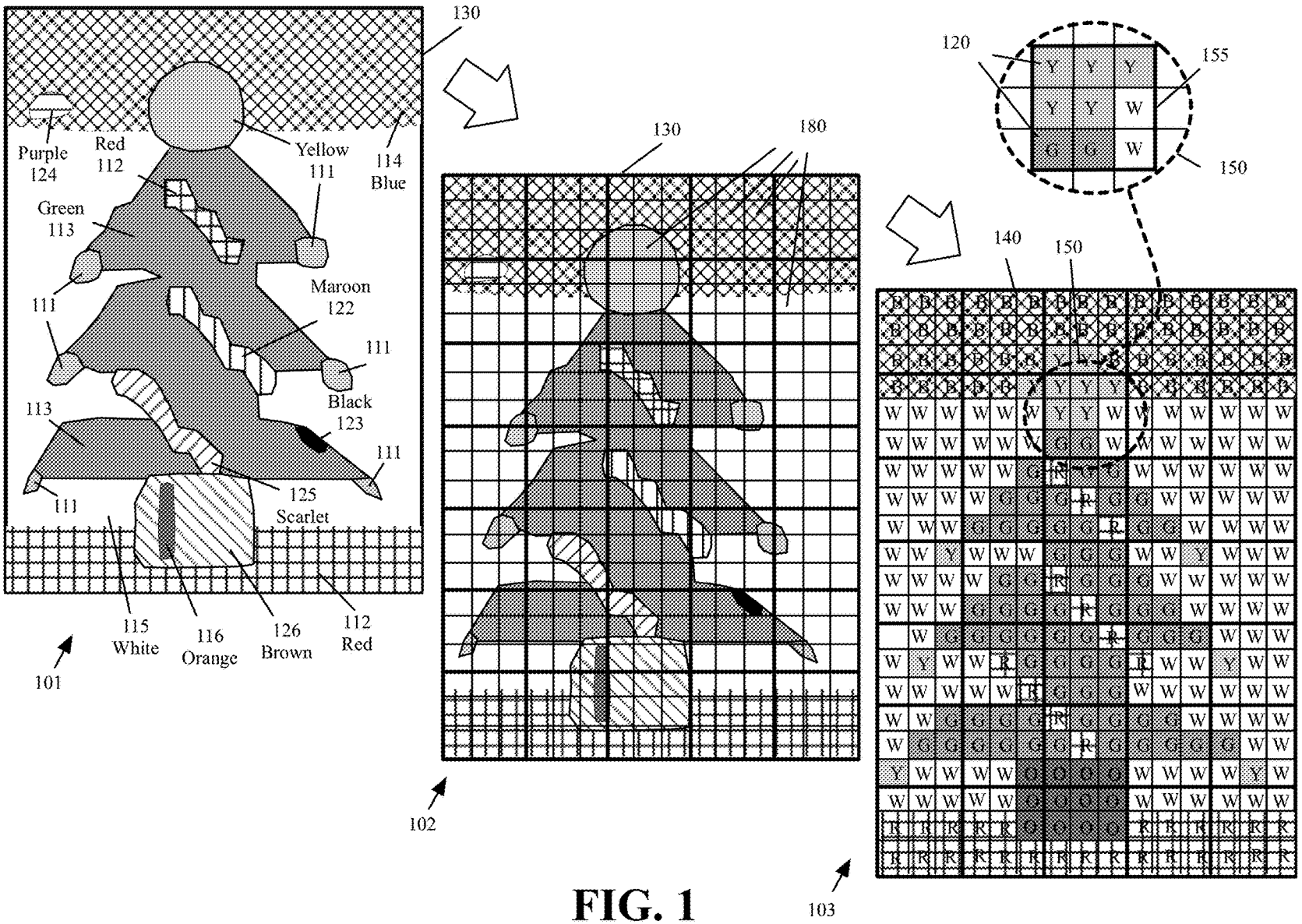
FIG. 1 is a functional diagram illustrating an example of transforming the original colors of an image into a color transformed image that has up to 6 different colors, according to various aspects of the present disclosure.

Some of the present embodiments may receive an image to be revealed by a group of participants in a game, a challenge, or a social media event. The game, challenge, or social media event may be administered by a computing device, such as a server. The participants may use cube puzzles, for example, a cube puzzle that may have 6 sides, each side having the same number of rows and blocks. The most common type of cube puzzles have nine blocks (i.e., 3 rows and 3 columns) on each one of their 6 faces (or sides). However, each face of some cube puzzles may include other plurality of blocks, such as for example and without limitations, 4, 16, 25, etc. To maintain simplicity, several examples of cube puzzles with nine blocks on each sides are described below. However, it should be understood that the present embodiments are applicable to cube puzzle that may include other number of blocks on each face than nine.

Each block of a cube puzzle may have one of 6 different colors. The cube puzzle may have an equal number of the blocks with the same color. Each side of the cube puzzle may be configured to rotate about an axis such that the orientation of the blocks is changed relative to other sides of the cube. In addition to changing the orientation of the blocks associated with the rotated face, the blocks may be moved so as to be associated with a different side. Each participant may be assigned a small region of the image and may rearrange the blocks of participant's cube puzzle such that the colors of the blocks on one side of the cube puzzle match the colors of the blocks in the participant's assigned region of the image.

The image may be a photograph, a painting, a drawing, etc. The image may be divided into a plurality of blocks. The image may be divided such that the number of blocks in the horizontal direction and the number of blocks in the vertical direction may be divisible by three to facilitate matching different regions on cube puzzles that have nine blocks on each side.

The image colors may then be transformed such that the color of the pixels in each block to be one of the 6 different colors that the blocks of a cube puzzle may have. Some embodiments may calculate the difference between the color of the pixels in each block with each of the 6 colors and may select one of the 6 colors for the block with the least calculated difference. The original color pixels of each block (i.e., the color pixels of each block prior to transforming the block to a unicolor block) may be stored in a storage for later display.

A plurality of adjacent unicolor blocks of the transformed image may be grouped into a region, where the region includes the same number of rows and columns as each face of the cube puzzles that are used in the game, challenge, or event. For example, when each face of the cube puzzles has nine blocks, the unicolor blocks of the transformed image may be grouped into a region of three rows and three columns. One or more regions may be assigned to each person participating in revealing the image. A participant may have a cube puzzle and a computing device. The computing device of the participant may receive and store the pattern of the region(s) assigned to the participant.

The image to be revealed may start being revealed with blank pixels. For example, all pixels may have the same generic color, such as gray or black pixels. In some embodiments at least some of the participants may be in a common area and the image to be revealed may be displayed on a screen located in the common area. In some embodiments, the image to be revealed may be sent to the computing devices of the participants and may be displayed on the computing device of the participant. Each participant may change the orientation of the blocks relative to other sides of the cube and/or may move the blocks to be associated with a different side until the color of the nine blocks on one side of the cube puzzle match the colors of the nine unicolor blocks of the region that the participant was assigned.

The participant's computing device may send a message to the server indicating that one side of the participant's cube puzzle has matched the color pattern of the assigned region. In some embodiments, some or all cube puzzles may include a processor and/or a wireless transceiver that may automatically send the message to the server once one side of the cube puzzle matches the assigned region. In some embodiments, some or all cube puzzles may be pure mechanical devices. In some of these embodiments, a picture of the side that matches the assigned region may be taken and sent to the server. In other embodiments, the participant or a proctor may send the message, through a computing device, to the server indicating that one side of the cube puzzle has matched the assigned region.

The corresponding region in the image may then be revealed by the server. A copy of the partially revealed image may be sent to computing devices of all participants and/or the partially revealed image may be displayed on a screen at a place where at least some of the participants are physically present. The image may be gradually revealed as the participants match one side of their cube puzzle to the color of the blocks to their assigned regions.

Once a region of the image is matched on the face of a participant's cube puzzle, some embodiments may reveal the unicolor of the blocks of the region. Other embodiments may reveal the original colors of the blocks in the region. Some embodiments may transition from the unicolor blocks to the original color blocks, for example, with an animation. Some embodiments may reveal the original color as each region is matched by a participant. Other embodiments may display the original colors after all regions on the image are matched by the participants.

When a participant matches an assigned region to the face of the participant's cube puzzle, the participant may be assigned more regions of the image to match on the participant's cube puzzle. The server may assign the next region for the participant, or the participant may select a new region from all available ones. Some embodiments may give scores to the participants for the numbers regions they match, for the speed they match their assigned region, etc. Some embodiments may allow participants to guess what the image is as different regions on the image are revealed and may assign points and/or prizes for correctly guessing the image.

The remaining detailed description describes the present embodiments with reference to the drawings. In the drawings, reference numbers label elements of the present embodiments. These reference numbers are reproduced below in connection with the discussion of the corresponding drawing features.

I. Using Cube Puzzles to Gradually Reveal an Image

Some of the present embodiments may receive an image to be revealed by a group of participants in a game, a challenge, or a social media event. The colors of the pixels in the image may be transformed to a set of 6 colors in order to facilitate matching different regions of the image to the faces of cube puzzles that may include block having one of the 6 colors.

FIG. 1 is a functional diagram illustrating an example of transforming the original colors of an image into a color transformed image that has up to 6 different colors, according to various aspects of the present disclosure. FIG. 1, as shown, includes three stages 101-103. In stage 101, a first image 130 may be received by a computing device, such as, for example, and without limitations, a server that may be used to administer a game, a challenge, and/or a social media event that may result in revealing the image 130 to a group of participants or to a larger audience. The image 130, referred to herein, as the original image, may be a photograph, a painting, a drawing, etc. The image 130 may include many different colors 111-116 and 121-125 (e.g., more than 6 colors).

In stage 102, the image 130 may be divided into a plurality of blocks 180. Only a few of the blocks 180 are labelled for clarity. Each block 180 may include one or more pixels. When a block 180 has more than one pixel, the pixels may have the same or different arbitrary colors.

Figure 2:
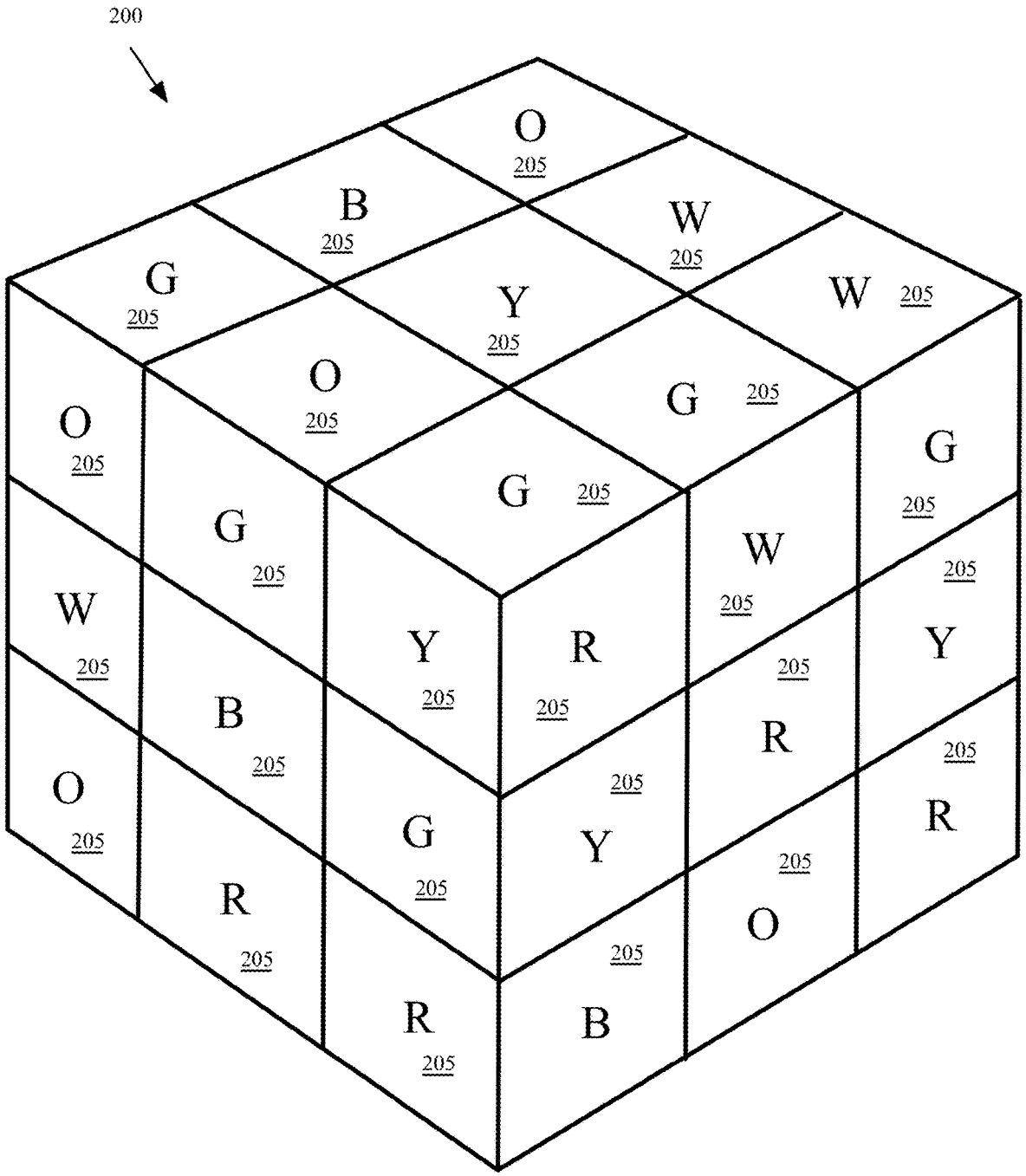
FIG. 2 Prior Art
FIG. 2 is a functional diagram illustrating a perspective view of an example of a prior art cube puzzle that may be used by the participants to match to different regions of the image to be revealed.

FIG. 2 illustrates a perspective view of an example of a prior art cube puzzle that may be used by the participants to match to different regions of the image to be revealed. With reference to FIG. 2, the cube puzzle 200 may include 6 sides (in the perspective view of FIG. 2, only three sides are shown). Each side may include nine blocks 205 arranged in a 3 by 3 matrix.

The blocks 205 may include one of 6 colors. In the example of FIG. 2, the 6 colors include Blue (labelled B), yellow, (labelled Y), green (labelled G), red (labelled R), orange (labelled O), and white (labelled W). It should be noted that cube puzzles may use a different set of 6 colors other than yellow, red, green, blue, white, and orange.

Each side of the cube puzzle 200 may be configured to rotate about an axis such that the orientation of the blocks may be changed relative to other sides of the cube. In addition, the blocks on one side of the cube puzzle 200 may be moved so as to be associated with a different side of the cube puzzle 200. In some embodiments, some or all cube puzzles used to match to the regions of an image may be fully mechanical. In some embodiments, some or all cube puzzles used may include a processor and a wireless transceiver in order to provide hints and feedback to computing devices of the participants, to communicate to the server(s) that administer the revealing of the image, etc. Although the cube puzzle of FIG. 2 includes 3 rows and 3 columns on each face, other cube puzzles used in some of the present embodiments may include other number of rows and columns (e.g., 2 rows and 2 columns, 4 rows and 4 columns, 5 rows and 5 columns, etc.).

Figure 3:
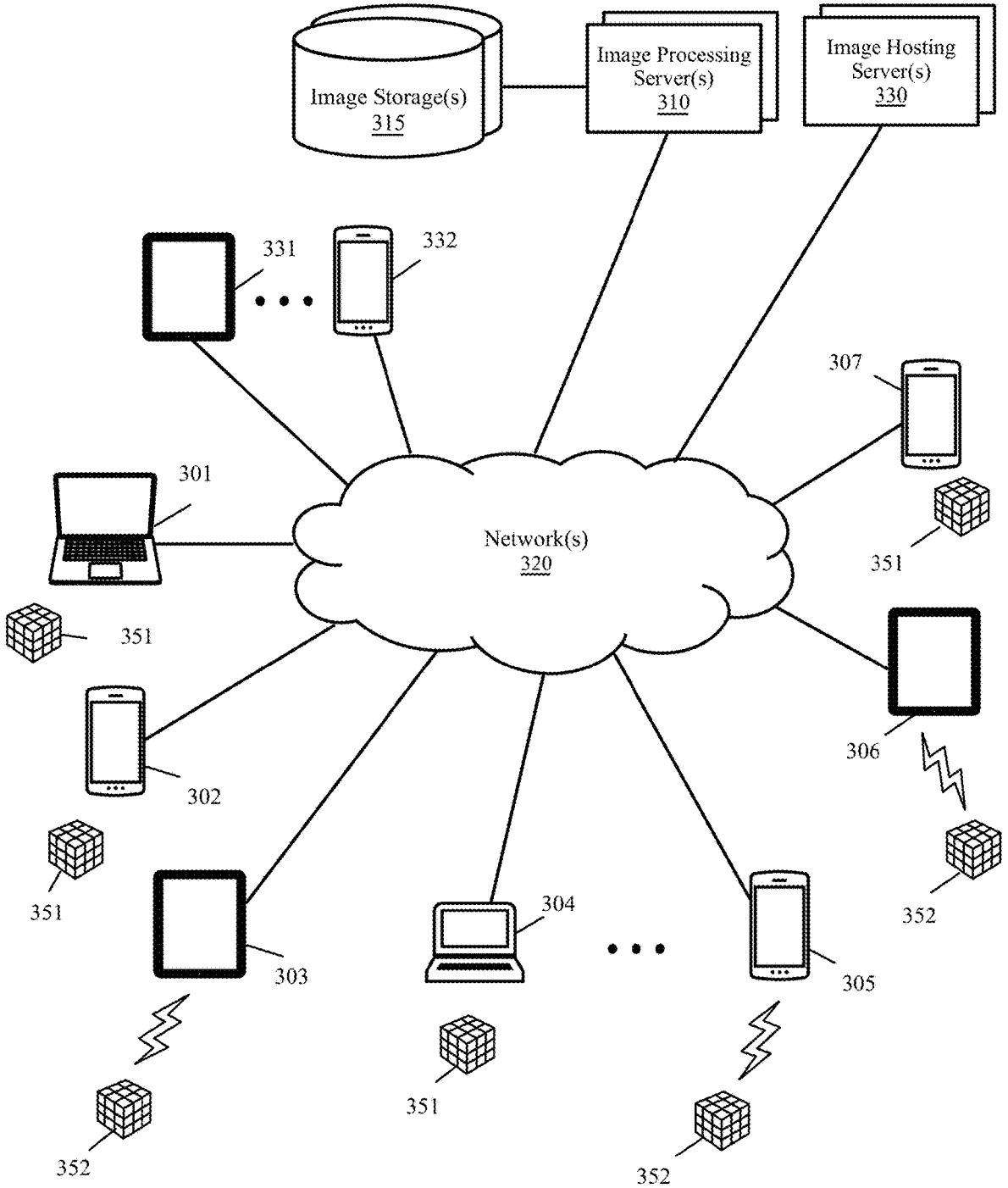
FIG. 3 is a functional block diagram illustrating an example system for gradually revealing an image by one or more participants using cube puzzles, according to various aspects of the present disclosure.

The transforming of the color of the image 130 of FIG. 1 and coordinating with the participants, in some embodiments, may be performed by one or more servers. FIG. 3 is a functional block diagram illustrating an example system for gradually revealing an image by one or more participants using cube puzzles, according to various aspects of the present disclosure. With reference to FIG. 3, the image processing server(s) 310 may be networked computing devices that connect to the client device 301-307 and 331-332 through one or more networks 320.

The image processing server(s) 310, in some embodiments, may host the image that is to be revealed. In other embodiments, the image processing server(s) 310 may send the image that is to be revealed to one or more image hosting servers 330. The image hosting servers 330 may be computing devices such as, for example, and without limitations, servers of social media sites such as Instagram or Facebook. Alternatively, instead of using the server(s) 310 and/or the server(s) 330, some embodiments may have a cube puzzle application program that may be executed on a computing device such as a desktop, a laptop, a smartphone, a tablet computer, etc.

With further reference to FIG. 3, the network(s) 320 may include the user's network (e.g., Wi-Fi, Ethernet, etc.), the Internet, telecommunication networks (e.g., public switched telephone network (PSTN), packet-switched network, etc.), and/or networks of servers/backend devices. The client devices 301-307 and 331-332 may include electronic devices such as desktop computers, laptop computers, tablet computers, smart phones, cellular telephones, personal digital assistant (PDA) devices, or other types of computing and/or communication devices. The image processing server(s) 310 may receive images, such as the image 130 of FIG. 1, from different client devices 331-332 through the network(s) 320. The image processing server(s) 310 may also retrieve images, such as the image 130 of FIG. 1, from one or more image storage storage(s) 315.

The client devices 301-307 may be associated with participants who may be collaborating or competing to reveal one or more images. Each participant may use a cube puzzle 351-352. Some of the cube puzzles, such as cube puzzles 351, may be mechanical devices. Some of the cube puzzles, such as cube puzzles 352, may be electro-mechanical devices that may include one or more processors and/or one or more wireless transceivers to provide hints and feedbacks to the computing devices of the participants, to communicate to the server(s) 310 and/or 330, etc.

The image processing server(s) 310 may transform the original images, such as the first image 130 of FIG. 1, into color transformed images, such as the second image 140 of FIG. 1 that includes only one color per block. The image processing server(s) 310 may store the original images 130 and/or the transformed images 140 in the image processing storage(s) 315. The image processing server(s) 310 may start a game, a challenge, or an event that may include one or more participant client devices 301-307.

Referring back to stage 102 of FIG. 1, the image 130 may be divided into a plurality (e.g., a matrix) of blocks 180 such that the number of blocks in the horizontal direction and the number of blocks in the vertical direction are divisible by three in order to facilitate matching different regions of the image with the blocks on the faces of the cube puzzles that have 3 rows and 3 columns. In the embodiments that the faces of cube puzzles used in the game, challenge, or social media event are not 3 by 3 and have a different number of rows and columns (e.g., and without limitations, 2 rows and 2 columns, 4 rows and 4 columns, 5 rows and 5 columns, etc.), the image 130 may be divided into a plurality of blocks 180 such that the number of blocks in the horizontal direction and the number of blocks in the vertical direction are divisible by the number of rows and columns of the cube puzzles used.

In stage 103, a second image 140 may be generated from the first image 130. The first image 130, in stage 103, may be transformed into the second image 140 with blocks that each may include one of only 6 colors that is used for the blocks of the cube puzzles 200 (FIG. 2). For example, and without limitations, the 6 different colors of the image 140 may be Blue (labelled B), yellow, (labelled Y), green (labelled G), red (labelled R), orange (labelled O), and white (labelled W).

Some embodiments may calculate the difference between the color of the pixels in each block with each of the 6 colors and may select one of the 6 colors for the block with the least calculated difference. As an example, the color brown 126 of the image 130 may be transformed into the color orange (labelled O) in the image 140. As another example, the colors red 112, maroon 122, and scarlet 125 in the image 130 may all be transformed into the color red (labelled R) in the image 140.

The original image 130 may be expressed in digital format as a plurality of pixels. Each pixel may have 3 or 4 color components to represent the color of the pixel. The pixel color components may be expressed, for example, and without limitations, in RGB (red-green-blue) format, CMYK (cyan, magenta, yellow, and key) format, HSL (hue, saturation, lightness) format, HSV (hue, saturation, value) format, etc.

Each one of the above-mentioned color models express the color of pixel by a set of 3 or 4 parameters. For example, the three RGB components may be expressed as three 8-bit numbers for each pixel. Each 8-bit RGB component may have 256 possible values, ranging from 0 to 255. For example, the three values (250, 165, 0), meaning (Red=250, Green=165, Blue=0), denote one orange pixel. Other examples include (255, 0, 0) denoting red, (0, 255, 0) denoting green, (0, 0, 255) denoting blude, (0, 0, 0) denoting black, (128, 128, 128) denoting gray, and (255, 255, 255) denoting white.

To map one pixel of an arbitrary color on the image 130 to one of the 6 colors of a cube puzzle 200, some embodiments use a minimum distance algorithm. If the arbitrary pixel on the image 130 is represented by (R, G, B) and the yellow color of the cube's pixels is represented by (Ry, Gy, By), then the distance between the arbitrary pixel of the image and the yellow color of the cube 200 (FIG. 2) is shown by Equation 1:

$$(R-Ry)2+(G-Gy)2+(B-By)**2 \quad \text{Eq. (1)}$$

The same calculation is done for other 5 colors of cube and the distance between the pixel on the image and all 6 colors of the cube may be calculated. When the blocks of the image 130 have only one pixel, some embodiments may identify one of the 6 colors of the cube that has the minimum calculated distance with the single pixel of each image block and may set the color of a pixel in the corresponding block of the image 140 to the color with the minimum calculated distance.

When the blocks of the image 130 have multiple pixels, some embodiments may first map each pixel of the block to one of the 6 colors of the cube using Equation (1) and then may select the color (out of the 6 colors) that is repeated the most for all pixels of the block. The color of all pixels in the corresponding block of the image 140 may then be set to the selected color. Alternatively, some embodiments may first average each one of the R, G, and B components of all pixels of the block to arrive at one set of averaged RGB values. The distance of that one averaged set of RGB values to the 6 colors of the cube may then be calculated using the Equation (1). One of the 6 colors of the cube that has the minimum calculated distance with the averaged set of RGB values may then be selected. The color of all pixels in the corresponding block of the image 140 may then be set to the selected color. A similar approach is used for the embodiments that use other color models, such as, for example, CMYK, HSL, HSV, etc.

With reference to FIG. 1, the original color pixels of each block prior to transforming the possibly multicolor blocks of the image 130 into the unicolor blocks of the image 140 may be stored in a storage in order to be revealed when all regions of the image are matched by the participants on their cube puzzles. In addition to transforming the multi-color blocks of the image 130 into the unicolor blocks of the image 140, the image 140 may be generated with a lower resolution than the original image 130 in order to generate fewer regions to match by the participants. For example, the original image 130 may be a high resolution image and the transformed image 140 may be a less dense, lower resolution, image. The lower resolution image 140 may be created by decimating the original image 130 and coming up, for example, and without limitations, with the average color of a region. For instance, a 1000 by 1000 pixel image 130 may be decimated to a 250 by 250 pixel image 140 by averaging a 4 by 4 array of pixels into 1 pixel. The image 140 may then be further transformed such that the pixels in each block only have one of the 6 colors used on the blocks of the cube puzzles.

With further reference to stage 103 of FIG. 1, each nine adjacent unicolor blocks of the image 140 may be grouped into a region. As shown in the expanded view 150, each region 155 may include three rows and three columns of unicolor blocks. The blocks 120 in the image 140 may have one of the 6 colors of a cube puzzle, for example, and without limitations, blue (labelled B), yellow, (labelled Y), green (labelled G), red (labelled R), orange (labelled O), and white (labelled W).

The image of different regions 155 (e.g., the image of the nine blocks shown in the expanded view 150) may be assigned, and may be sent, by the server(s) 310 of FIG. 3 to the client devices 301-307. Each client device may be assigned one or more regions to match. The client devices 301-307 may display the image(s) of the assigned region(s). The participants may then use their cube puzzles and may change the positions of the blocks of their cube puzzles until the colors of the blocks on one face of their cube puzzle match the color of the blocks of the assigned region of the image.

Figure 4:
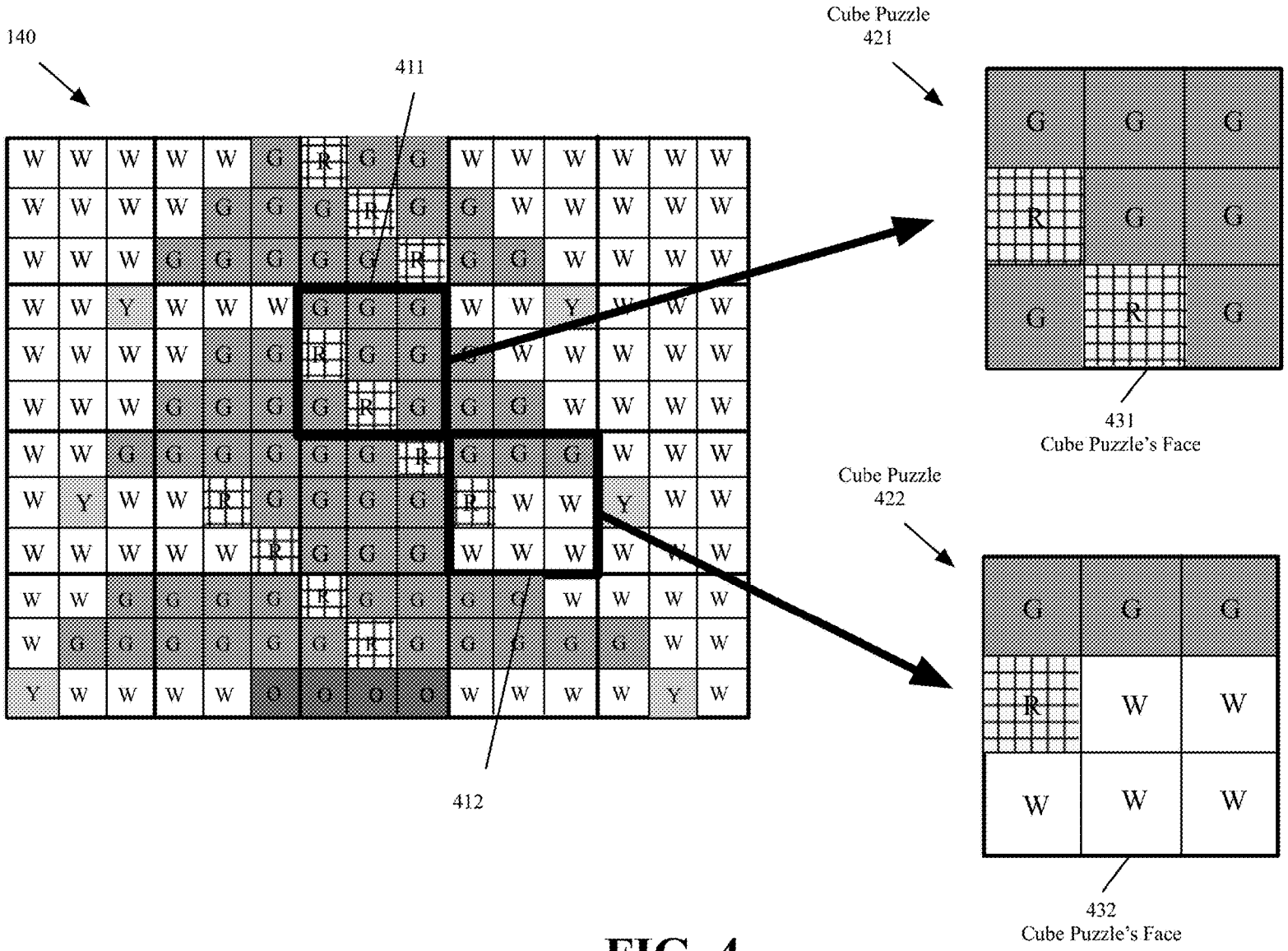
FIG. 4 is a functional diagram illustrating an example of assigning different regions of an image to different participants to match the region's color pattern on the faces of their cube puzzles, according to various aspects of the present embodiments.

FIG. 4 illustrates an example of assigning different regions of an image to different participants to match the region's color pattern on the faces of their cube puzzles, according to various aspects of the present embodiments. With reference to FIG. 4, a portion of the image 140 of FIG. 1 is shown. The region 411 of the image 140 may be assigned to a person that has the cube puzzle 421. The region 412 may be assigned to a person that has the cube puzzle 422.

FIG. 4 shows the face 431 of the cube puzzle 421 after the nine blocks of the face 431 are rearranged to match the color pattern of the nine blocks of the region 411. FIG. 4 also shows the face 432 of the cube puzzle 422 after the nine blocks of the face 432 are rearranged to match the color pattern of the nine blocks of the region 412. The colors of the blocks of the assigned blocks may then be sent to the electronic devices that are associated with the cube puzzles to which the regions are assigned. For example, an image of an assigned region, or a message indicating the colors and the location of each block within the region, may be sent to the electronic device that is associated with the cube puzzle to which the region is assigned.

Figure 5:
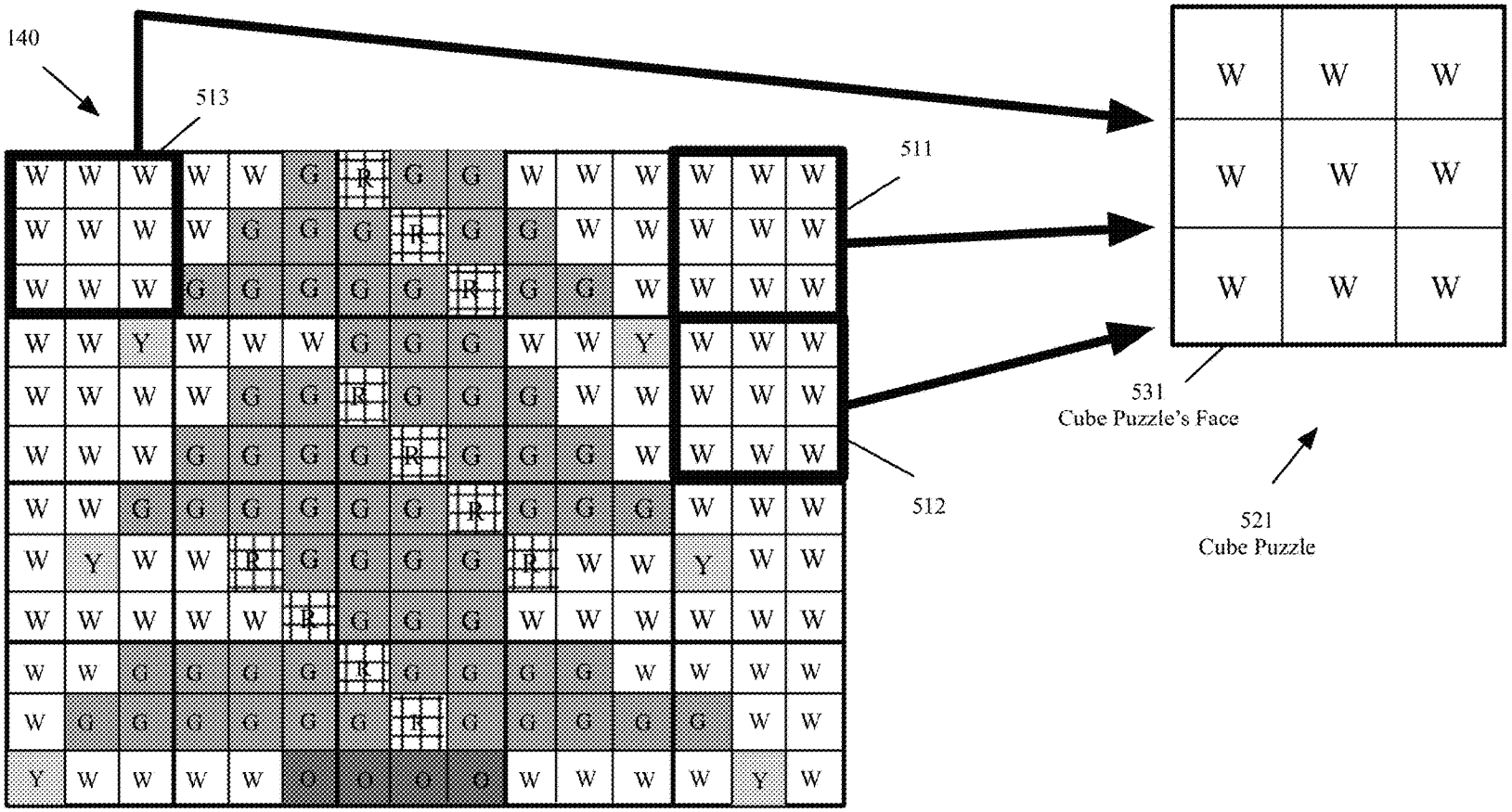
FIG. 5 is a functional diagram illustrating an example of several regions of an image with the same color pattern that may be matched to the color pattern of the block on the face of one cube puzzle, according to various aspects of the present embodiments.

It may be possible that multiple regions of 3 by 3 boxes in the image 140 may have the same color pattern and may be mapped to the same 3 by 3 block face of a cube puzzle. FIG. 5 illustrates an example of several regions of an image with the same color pattern that may be matched to the color pattern of the block on the face of one cube puzzle, according to various aspects of the present embodiments.

With reference to FIG. 5, the regions 511, 512, and 513 all have nine blocks with the same color pattern (in this example all blocks are white). Assuming that the region 511 is assigned to the participant that is using the cube puzzle 521, the participant may have matched all blocks of the face 531 to the color pattern of the blocks of the region 511. In some embodiments, when the color of a region is matched on the face of a cube puzzle, only the assigned region 511 of the image 140 may be revealed. In other embodiments, when the color of a region is matched on the face of a cube puzzle, several regions (e.g., the regions 511 and 512 or the regions 511 and 513) of the image 140 may be revealed. Yet, in some embodiments, when the color of a region is matched on the face of a cube puzzle all regions of the image 140 with the similar pattern may be revealed.

There may be multiple ways to recognize that the cube puzzle of a participant has matched the assigned region. In the cube puzzles that include a processor (e.g., the cube puzzles 352 of FIG. 3), the cube state may be monitored by the processor of the cube to know exactly when the cube puzzle has solved one of the needed patterns. In the mechanical cube puzzles that do not include a processor (e.g., the cube puzzles 351 of FIG. 3), a camera on a computing device 301-307 of FIG. 3 may be used to recognize the face of the cube that has matched the pattern of an assigned region and may send the image and/or a message to the servers 310 and/or 330. The servers 310 and/or 330 may analyze the image to verify that the cube puzzle has matched the assigned region. In some embodiments, a participant, or a proctor, may manually indicate that a side of the participant's cube has matched an assigned pattern and may send a message through a computing device, such as the client devices 301-307 to the servers 310 and/or 330.

Figure 6:
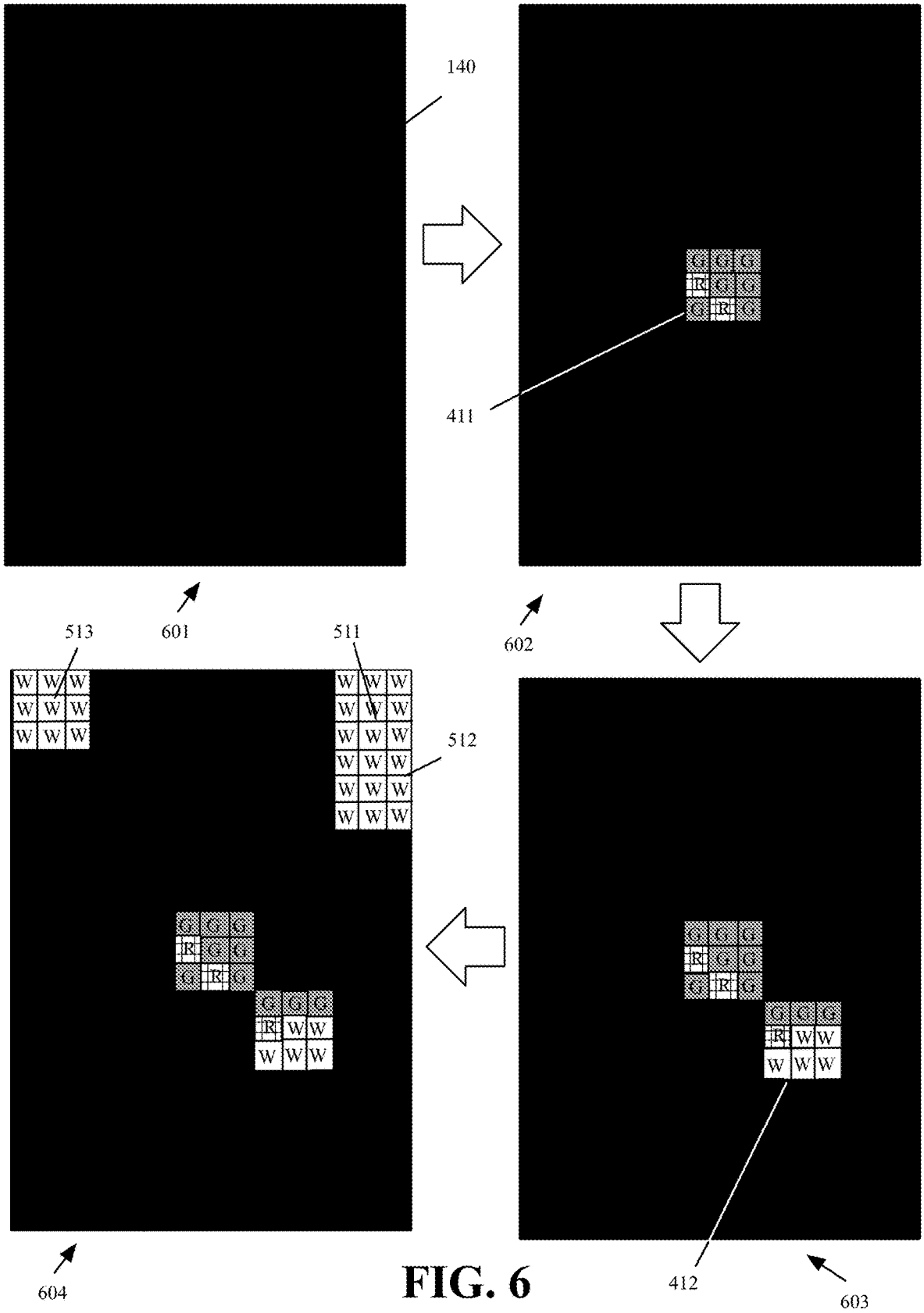
FIG. 6 is a functional diagram illustrating the image of FIG. 1 being gradually revealed as different regions are matched by the cube puzzles of the participants, according to various aspects of the present embodiments.

As the participants match different regions of the image to the faces of their cube puzzles, the image may be gradually revealed. FIG. 6 illustrates the image 140 of FIG. 1 being gradually revealed as different regions are matched by the cube puzzles of the participants, according to various aspects of the present embodiments. FIG. 6, as shown, may include four operational stages 601-604. In stage 601, the image to be revealed may start with blank pixels. For example, all the pixels may have the same generic color, gray or black pixels. The image 140 in the example of FIG. 6 may start being revealed with all pixels having a black color.

The image to be revealed 140 may be hosted by a computing device, such as the image processing server(s) 310 of FIG. 3, or may be sent by the image processing server(s) 310 to a computing device, such as the image hosting server(s) 330 that may be, for example, social media servers, web servers, etc. The participant's computing devices 301-307 may access the image, for example, by a browser. The image to be revealed 140 may be sent to the participant's computing devices 301-307 and may be displayed on the display of the participant's computing devices 301-307 by an application program, etc.

With further reference to FIG. 6, as each set of pixels is solved locally by a participant, the image to be revealed may be updated to dynamically reflect the new pixels. For example, stage 602 shows the image 140 after the region 411 of FIG. 4 is matched on the face 431 of the participant's cube puzzle 421. The electronic device associated with the cube puzzle 421, or a person, such as a proctor observing the cube puzzle 421, may send a message to the server 310 or the server 330 to indicate that the assigned region 411 is matched to the blocks on a side of the cube puzzle 421.

In addition to, or in lieu of revealing the unicolor region 411, some embodiments may retrieve the original multicolor region of the image 130 (FIG. 1) from the image storage(s) 315 (FIG. 3) and may reveal the original multicolor block. Some embodiments may assign further regions to a participant at once and/or may assign additional regions to the participants as the participants match their assigned regions on their cube puzzles.

Stage 603 shows the image 140 after the region 412 of FIG. 4 is matched on the cube puzzle of the same participant or by a different participant. Stage 604 shows the image 140 after the region 511 is matched on the cube puzzle of a participant. As described above, once a region's color patterns are matched on a cube puzzle face, some embodiments (such as the embodiment of FIG. 6) may reveal all regions that have the same color pattern. Other embodiments may reveal only the region 511 that was assigned to the participant that has matched it. Yet, other embodiments may reveal several regions with the same color pattern (e.g., the regions that are not assigned to a participant yet).

With further reference to FIG. 6, when a participant matches the pattern on a cube puzzle device, the region that is matched may be revealed. Some embodiments may reveal the region's unicolor blocks, which may be one of 6 different colors. Other embodiments may reveal the colors of the original image 130 (FIG. 1) where each block may include pixels of several different colors and the colors are not limited to the 6 colors of the blocks of the cube puzzles. If the image 140 was compressed, some embodiments may disclose the low resolution pixels of the compressed image while other embodiments may display the pixels of the original high resolution image 130. For example, a block of 3 by 3 pixels in the compressed image may be replaced by the original 12 by 12 block pixels form the uncompressed image 130 (FIG. 1).

With continued reference to FIG. 6, the image 140 may be live updated to reveal more pixels as more regions are matched on the participant's cube puzzles. Some embodiments may include a time component, for example, by using a movie or animated graphics interchange format (GIF) structure to show the change over time on the image. Some embodiments may include a time-base component whereas even while the participants are working to reveal different regions of the image, some of the pixels may be automatically released to make sure the full image is exposed at a certain time and date. For example, one or more timers may start at the beginning of the game, challenge, or event and certain regions of the image may be revealed after the expiration of each timer even if some of the regions have not been matched by the participant. In some embodiments, the entire image may be hierarchical, where solving one pattern, may lead to higher resolution patterns that also need to be solved. In some of these embodiments, the highest level patterns may be sent to different participants to reveal once one of the participants matches the low resolution pixels of the region. In other embodiments, each participant may continue working on their assigned region of the image to reveal the higher resolution pixels.

Figure 7:
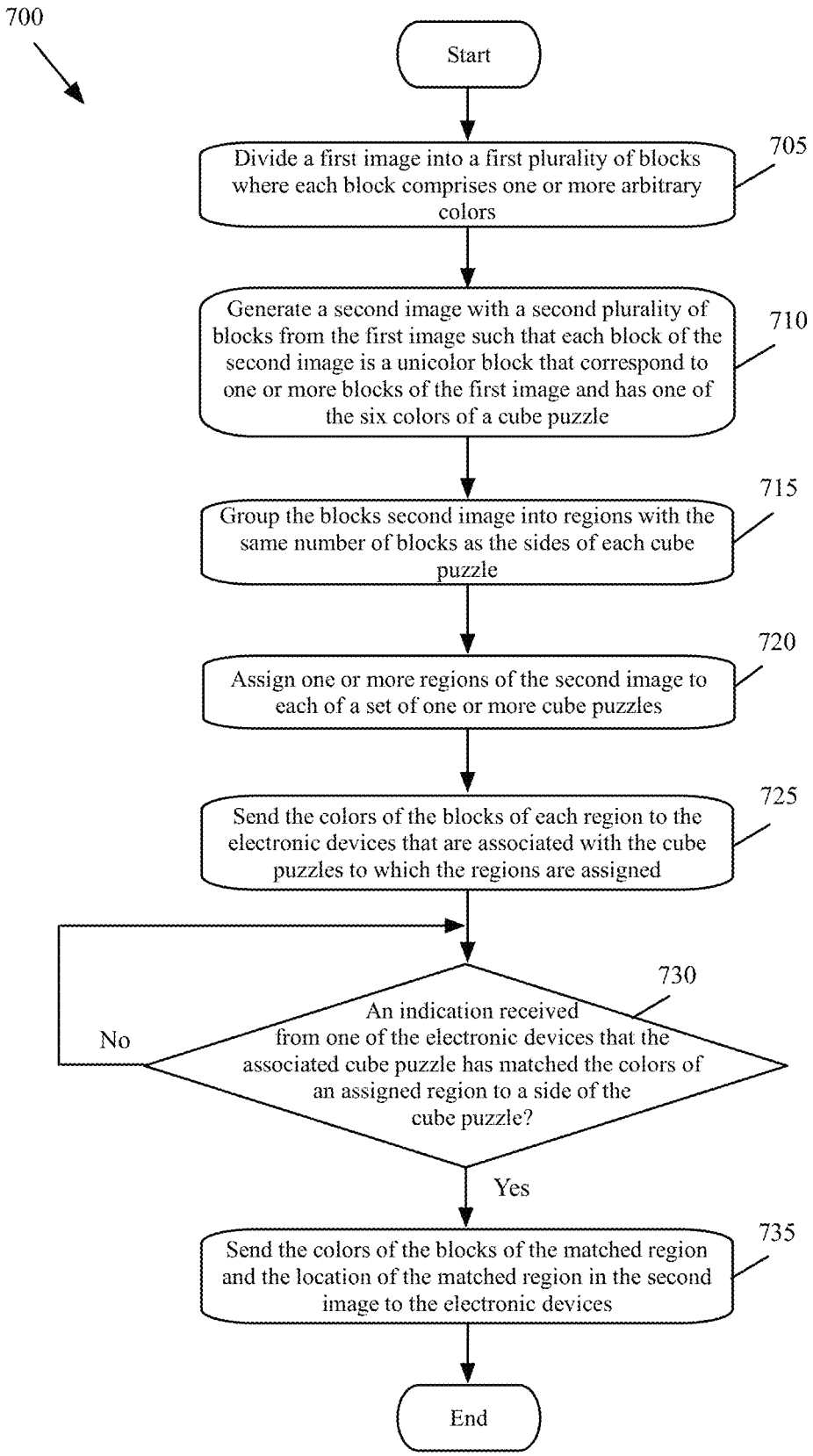
FIG. 7 is a flowchart illustrating an example process for gradually revealing an image to a plurality of persons which are assigned regions of the image to match on the sides of their cube puzzles, according to various aspects of the present disclosure.

FIG. 7 is a flowchart illustrating an example process 700 for gradually revealing an image to a plurality of persons which are assigned regions of the image to match on the sides of their cube puzzles, according to various aspects of the present disclosure. The process 700, in some of the present embodiments, may be performed by the processor of a computing device, such as a server 310 or 330 of FIG. 3.

With reference to FIG. 7, a first image may be divided (at block 705) into a first plurality of blocks where each block comprises one or more arbitrary colors. For example, as described with reference to stage 102 of FIG. 1, the image 103 may be divided into a first plurality of blocks 180 where each block may have one or more arbitrary colors.

A second image with a second plurality of blocks may be generated (at block 710) from the first image such that each block of the second image is a unicolor block that corresponds to one or more blocks of the first image and has one of the 6 colors of a cube puzzle. For example, as described above with reference to stage 103 of FIG. 1, the second image 140 may be generated from the first image 130 where each block 120 of the second image 140 corresponds to one or more blocks 180 of the first image and has one of the 6 colors of a cube puzzle.

The blocks of the second image are grouped (at block 715) into regions with the same number of blocks as the sides of each cube puzzle. For example, as described above with reference to FIG. 4, the blocks of the second image 140 may be grouped into several regions 411-412. The regions 411-412 may have the same number of rows and columns as one of the sides of a cube puzzle, such as the cube puzzle 200 of FIG. 2.

One or more regions of the second image are assigned (at block 720) to each of a set of one or more cube puzzles. For example, as described above with reference to FIG. 4, the regions 411 and 412 may be assigned to two different persons that are associated with the two cube puzzles 431 and 432, respectively.

The colors of the blocks of each region may be sent (at block 725) to the electronic devices that are associated with the cube puzzles to which the regions are assigned. For example, as described above with reference to FIG. 4, an image or a message identifying the color and the location of each block within the region may be sent to the electronic devices that are associated with the cube puzzles to which the regions are assigned.

A determination may be made (at block 720) whether an indication is received from one of the electronic devices that the associated cube puzzle has matched the colors of an assigned region to a side of the cube puzzle. For example, as described above with reference to stage 602 of FIG. 6, the color of the blocks of the region 411 may be matched to the colors of the blocks on a side 431 of the cube puzzle 421. When such an indication is not received, the process 700 may proceed to block 730, which was described above. Otherwise, the colors of the blocks of the matched region and the location of the matched region in the second image are sent (at block 735) to the electronic devices of all participants in order to reveal the matched region on the displays of the electronic devices. The process 700 may then end.

The specific operations of the process 700 may not be performed in the exact order shown and described. Furthermore, the specific operations described with reference to FIG. 7 may not be performed in one continuous series of operations in some embodiments, and different specific operations may be performed in different embodiments. For example, in some aspects of the present embodiments, operations 730 and 735 may be repeated until some or all of the regions of the second image are matched by the cube puzzles of the participants and the second image is gradually revealed to the participants. Several other alternatives operations for the process 700 to gradually reveal an image are described in the following section.

II. Example Embodiments

In some embodiments, the participants may use a cube puzzle that includes one or more processors (or controller). The cube puzzle, in some embodiments, may include one or more wireless transceivers. The wireless cube puzzle, for example, and without limitations, may include a Bluetooth and/or a Wi-Fi transceiver. A cube puzzle with processor(s) and/or wireless transceiver(s) is described in U.S. Pat. No. 10,643,494, entitled "Cube Puzzle Solver," and U.S. Pat. No. 10,810,905, entitled "Smart Cube Puzzle and User Device Application." The contents of the U.S. Pat. No. 10,643,494 and of the U.S. Pat. No. 10,810,905 are hereby incorporated by reference.

The cube puzzle may be a device that may have 6 sides, each side having a number of blocks (e.g., 4 blocks, 9 blocks, 16 blocks, 25 blocks, etc.). Each side may be able to be rotated about an axis such that the orientation of the blocks is changed relative to other sides of the cube (e.g., by rotating a face clockwise by ninety degrees, one hundred eighty degrees, two hundred seventy degrees, etc.). In addition to changing the orientation of the face of the blocks associated with the rotated face, other blocks may be moved so as to be associated with a different side. For instance, corner blocks of the cube may be associated with three faces of the cube where movement of a particular face may cause one or more faces of each block to be associated with a different side.

A cube puzzle may have square sides and square blocks. The cube puzzle may be in a solved state when the blocks of one or more sides all match a particular color pattern. In some embodiments, the default solved state may be a state where all faces have the same color blocks. However, the cube puzzles of the present embodiments may include different solved states. For example, the solved state may be a state where the color pattern of the blocks on one face of the cube puzzle matches the color pattern of a region of the image being revealed.

The cube puzzle device may include various position sensors. Such sensors may be able to identify the rotation of each face of the puzzle. The position sensors may include relative and absolute position sensors. The cube puzzle device may utilize the position sensors to determine (and/or update) the current state of the puzzle. The current state may be utilized to generate a solution to achieve the target state. The solution may be presented to a person using the cube puzzle via various user interface elements of the device (e.g., arrows indicating a rotation direction for each face). Such solution steps may be presented when a user requests instruction. Some embodiments may automatically determine when a solution has been achieved by comparing a current state of the device to the target state.

Some embodiments may allow communication between cube puzzles and external electronic devices (e.g., desktops, laptops, smartphones, tablets, etc.). Such electronic devices may execute a cube puzzle application program that may be able to provide instructions to the person using the cube puzzle, to receive a state of the puzzle, to share results across various platforms, and/or to perform other appropriate tasks.

The wireless cube puzzle may connect to client devices, such as the client devices 301-307 of FIG. 3, to a voice-based AI-powered digital assistant, such as an Alexa Echo device, to a virtual assistant (VA) device, to remote servers, such as the servers 310 and/or 330, etc. The wireless cube puzzle may serve as a platform to send the participants patterns, and send the results of rearranging of the cube puzzle (e.g., the pattern on one or more faces of the cube puzzle) to the server(s) 310 to aggregate from many different users. The wireless cube puzzle may have a corresponding cube puzzle application program (cube puzzle app) that may be the main host to provide access for each participant to contribute to the revealing of the image. The image revealing may also be done through a webpage that may host the image.

The cube puzzle application program may communicate with the server(s) 310 and/or 330 (FIG. 3) that may be hosted in any cloud service such as Amazon's AWS or Microsoft's Azure. The server(s) 310 and/or 330 may also be standalone web server(s). The server(s) 310 and/or 330 may post an image, such as the image 140 of FIG. 1, that is to be solved by the participants. The image 140 may be broken down into the individual 3 by 3 unicolor blocks, as described above with reference to FIG. 1.

The cube puzzle application program and/or the server(s) 310, 330 may select an image to be synthesized using the colors of the faces of the cube puzzles (e.g., and without limitations, red, green, orange, blue, white, and yellow). The image may be divided and color transformed such that it may include a matrix of M by N regions to be reconstructed by a group of cube puzzles.

The original image may be converted by following the following procedure. The image may be divided into K by L blocks where K=3*M and L=3*N. If X and Y are, respectively, the horizontal and vertical resolutions of the original image, then each one of the K×L blocks may be (X/K)*(Y/L) pixels.

Each one of the blocks may be approximated by one of the 6 colors of the cube puzzle and all pixels in that block may be set to that color. The image may be publicly available from the server(s) 310 and/or 330, and may allow everyone or a selected group of participants to see the total progress towards revealing the image. The participants who want to participate in reconstructing the image from the cube patterns may use the cube puzzle application program to request to participate. For example, the participant, through a browser running on a computing device, may access special universal resource locator (URL) that automatically opens the cube puzzle application program when clicking on an online image, through a friend request, email or other method.

The cube puzzle application program may communicate with the serve(s) 310 and/or 330 and may retrieve the next available image region that may help solve the image. For example, the serve(s) 310 and/or 330 may pick a random 3 by 3 block of the image (these 3 by 3 pieces may be modulo 3 boundaries starting from any corner of the image) and may assign that pattern to the participant. The participant may now start making that pattern on one of the faces of the participant's cube puzzle.

In some embodiments, the participants may snap pictures or select their own images, and just build a local image they want to work on, or share with only a select set of persons. The images may be smaller for a quick completion, or may be very large that may require a long time to fully reveal.

For the participants that are using the cube puzzle application program, the application program may receive the pattern that should be matched by the participant from the server(s) 310 and/or 330 and may track the participant's movements. Once the pattern that is assigned to the participant is matched on a face of the participant's cube puzzle, the application program may send a message to the server(s) 310 and/or 330 signaling the completion of that particular pattern.

The server(s) may manage the conflicts. For example, when more than two participants are assigned to match the color pattern of the same region, the server may fill on the first received portion, and may continue to send requests for other regions back to the participant's device. In some embodiments, a participant may request and lock a particular 3 by 3 pattern pixel until they are complete. In other embodiments, the server may broadcast all available patterns to work on, and just take in the first solved one. A participant, in some embodiments, may request another pattern and if one is still available it will be sent the same way as above.

The server(s) 0310 and/or 330 or the local cube puzzle application program of a participant may keep track of the number of patterns each participant solves and the time it takes for each pattern to be solved. The participants may get a score based on that data, and for that image, over any time period (e.g., and without limitations, last month, last week, etc.). The participants may see their contributions.

In some embodiments, any user may try to guess what the final image is going to look like and name the image while the participants are working to reveal the image. The earlier in the game a participant gets the correct answer, the higher the score the participant may get.

The completion of the image may also be used to trigger even more operations. For example, the completion of a post may trigger a release of another social media post, such as a video, more pictures, a music video, etc. The release of new content or the image itself may be only for the participants that contributed to the puzzle, or for the wider public audience. Furthermore, the solved image, once revealed, may unlock local rewards, such as virtual currency, discount offers, or another specialized content to one or more participants. This may be in the form of discount codes on the cube puzzle application program, or discount codes for online purchases with other retailers. The revealed image may open up bigger webpages, and may enable browsing through a wide variety of content.

In some embodiments, a user may be randomly playing with the 3 by 3 puzzle, and if at any point their cube matches a part of the image, it may automatically send the patterns to the server, and work to complete the images. This behavior helps reward users for playing with the cube, without explicitly serving patterns to solve.

The order of how the server(s) 310 and/or 330 send(s) requests may follow many patterns. For example, the server(s) may send the most important patterns first so the rough pattern may be revealed quickly. This is important in the case where one pattern may reveal many different parts of the image. The serve(s) may break apart the image into the least number of revealed pixels, to delay the final image to be recognized. The server(s) may completely randomize the patterns, or may focus on some regions first before other regions. This approach may include manually defined regions and ordering to maximize the impact.

In some embodiments, multiple participants may be working against each other to flip pixels back to the images assigned to them. This means that the speed component may enable one participant to lock pixels that cannot be changed, or continuously flip them so that multiple users are racing to get different images revealed. In some embodiments, there may be a threshold, and after a certain percentage of the pixels are revealed, that image wins, but until that point, different images are being completed.

III. Computer System

Figure 8:
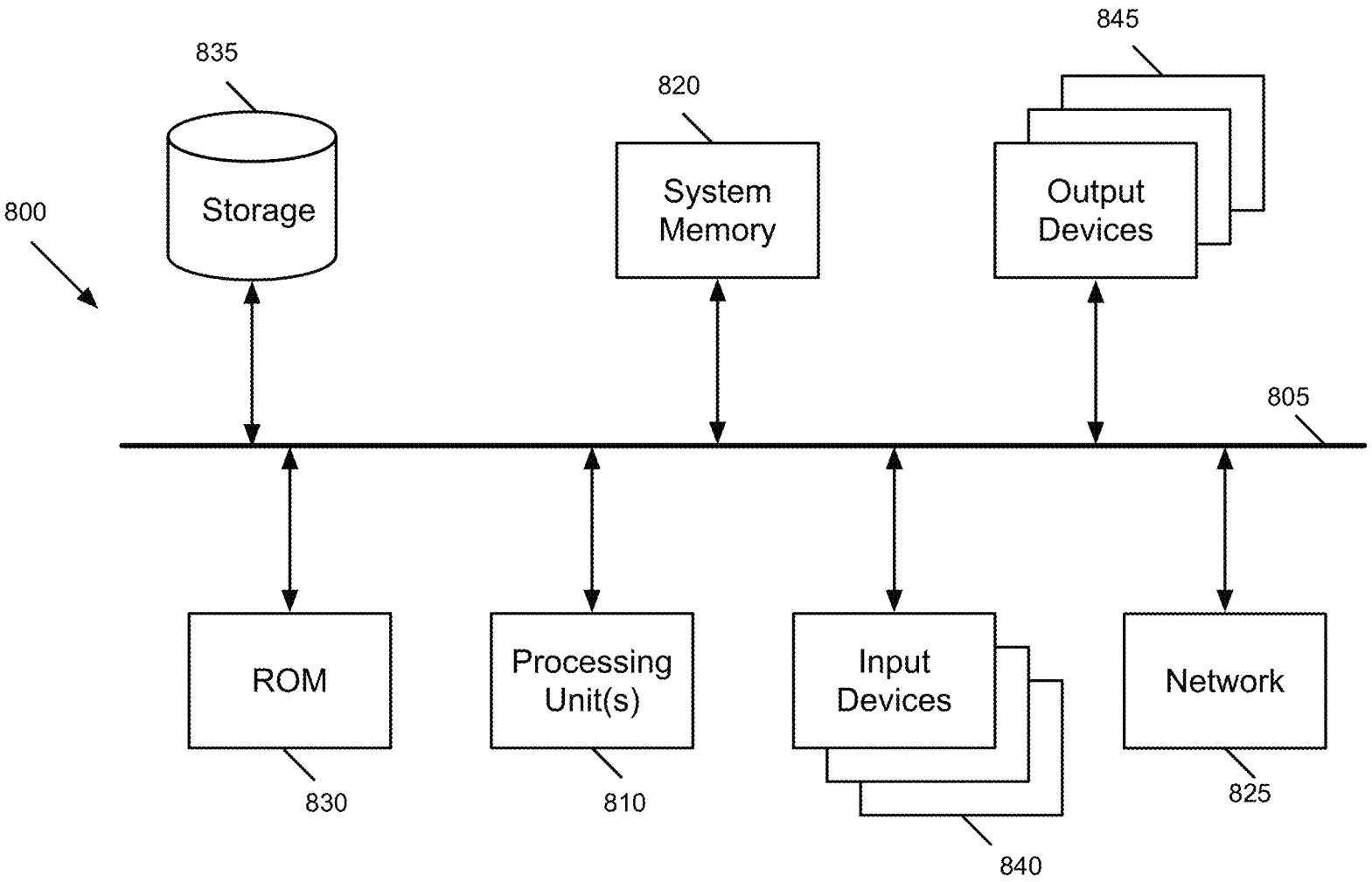
FIG. 8 is a functional block diagram illustrating an example electronic system, according to various aspects of the present disclosure.

FIG. 8 is a functional block diagram illustrating an example electronic system 800, according to various aspects of the present disclosure. With reference to FIG. 8, some present embodiments may be implemented using some or all components of the electronic system 800. The electronic system 800 may be used to execute any of the processes, methods, controls, or operating system applications described above. The electronic system 800 may be a computer (e.g., a desktop computer, laptop computer, a personal computer, a tablet computer, a server computer, a mainframe, a blade computer etc.), a phone (e.g., a smartphone), a personal digital assistant (PDA), or any other sort of electronic device. Such an electronic system may include various types of computer readable media and interfaces for various other types of computer readable media. The electronic system 800 may include a bus 805, processing unit(s) 810, a system memory 820, a read-only memory (ROM) 830, a permanent storage device 835, input devices 840, and output devices 845.

The bus 805 may collectively represent all system, peripheral, and chipset buses that communicatively connect the numerous internal devices of the electronic system 800. For example, the bus 805 may communicatively connect the processing unit(s) 810 with the read-only memory 830, the system memory 820, and the permanent storage device 835.

From these various memory units, the processing unit(s) 810 may retrieve instructions to execute and data to process in order to execute the processes of the present embodiments. The processing unit(s) may be a single processor or a multi-core processor in different embodiments.

The read-only-memory 830 may store static data and instructions that are needed by the processing unit(s) 810 and other modules of the electronic system. The permanent storage device 835, on the other hand, may be a read-and-write memory device. This device is a non-volatile memory unit that may store instructions and data even when the electronic system 800 is off. Some present embodiments may use a mass-storage device (such as a magnetic or optical disk and its corresponding disk drive) as the permanent storage device 835.

Other embodiments may use a removable storage device (such as a floppy disk, flash drive, etc.) as the permanent storage device. Like the permanent storage device 835, the system memory 820 may be a read-and-write memory device. However, unlike storage device 835, the system memory may be a volatile read-and-write memory, such as random access memory. The system memory may store some of the instructions and data that the processor needs at runtime. In some embodiments, the processes may be stored in the system memory 820, the permanent storage device 835, and/or the read-only memory 830. From these various memory units, the processing unit(s) 810 may retrieve instructions to execute and data to process in order to execute the processes of some embodiments.

The bus 805 may also connect to the input and output devices 840 and 845. The input devices may enable the user to communicate information and select commands to the electronic system. The input devices 840 may include alphanumeric keyboards, pointing devices (also called "cursor control devices"), audio recorders, still and/or video cameras. The output devices 845 may display images generated by the electronic system. The output devices 845 may include one or more speakers. The output devices may include printers and display devices, such as cathode ray tubes (CRT) or liquid crystal displays (LCD). Some embodiments may include devices such as a touchscreen that function as both input and output devices.

Finally, as shown in FIG. 8, the bus 805 may also couple the electronic system 800 to a network 825 through a network adapter (not shown). In this manner, the computer may be a part of a network of computers (such as a local area network ("LAN"), a wide area network ("WAN"), an Intranet, or a network of networks, such as the Internet. Any or all components of the electronic system 800 may be used in conjunction with the present embodiments.

Some embodiments may include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra-density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some embodiments may be performed by one or more integrated circuits, such as application specific integrated circuits (ASICs) or field programmable gate arrays (FPGAs). In some embodiments, such integrated circuits may execute instructions that are stored on the circuit itself. Some of the present embodiments may include flexible circuit, also rereferred to as flexible printed circuit boards (PCBs). The flexible circuits may provide dynamic flexing and increased heat dissipation and may be used in the embodiments that require circuits with smaller footprint, increased package density, more tolerance to vibrations, and/or less weight.

As used in this specification, the terms "computer", "server", "processor", and "memory" all refer to electronic or other technological devices. These terms exclude people or groups of people. For the purposes of the specification, the terms display or displaying means displaying on an electronic device. As used in this specification, the terms "computer readable medium," "computer readable media," and "machine readable medium" are entirely restricted to non-transitory, tangible, physical objects that store information in a form that is readable by a computer. These terms exclude any wireless signals, wired download signals, and any other ephemeral or transitory signals.

In a first aspect, an automated method of gradually revealing images by a computing device to a set of one or more electronic devices is provided. Each electronic device is associated with a cube puzzle, each cube puzzle has six sides, each side comprises a plurality of blocks, each block of the cube puzzles comprises one of a plurality of six colors. The method comprises: dividing a first image into a first plurality of blocks, each block in the first plurality of blocks comprising a set of one or more colors; generating the first image into a second image by the computing device, the second image comprising a second plurality of blocks, each block in the second plurality of blocks corresponding to a set of one or more blocks in the first plurality of blocks, each block in the second plurality of blocks being a unicolor block comprising one color from the plurality of six colors of the cube puzzles' blocks; grouping the second plurality of blocks into a plurality of regions by the computing device, each region comprising a same number of blocks as the plurality of blocks of a side of a cube puzzle; assigning one or more regions of the second image to each cube puzzle; sending the colors of the blocks of each region, from the computing device, to the electronic devices associated with the cube puzzles to which the regions are assigned; receiving an indication, by the computing device, that the colors of the blocks on a side of the cube puzzle associated with the electronic device are matched to the colors of the blocks of the region assigned to the cube puzzle; sending the colors of the blocks of the matched region and a location of the matched region in the second image from the computing device to the set of electronic devices; and repeating the receiving of an indication from an electronic device in the set of electronic devices and the sending of the colors of the blocks of a matched region and a location of the matched region a plurality of times to reveal at least a portion of the second image to the set of electronic devices.

In an embodiment of the first aspect, each of the first and second images comprises a plurality of pixels, wherein each pixel has a color, wherein generating the first image into the second image comprises generating each pixel of the first image having an arbitrary color into a corresponding pixel of the second image having one of the plurality of colors of six colors of the cube puzzles' blocks.

In another embodiment of the first aspect, each of the first and second images comprises a plurality of pixels, wherein each pixel has a color, wherein generating the first image into the second image comprises mapping each of a plurality of the pixels of the first image having arbitrary colors into one pixel of the second image having one of the plurality of colors of six colors of the cube puzzles' blocks.

An embodiment of the first aspect further comprises assigning one or more additional regions of the second image to a cube puzzle after the colors of the blocks on a side of the cube puzzle are matched to the colors of the blocks of the region assigned to the cube puzzle.

Another embodiment of the first aspect further comprises sending the one or more blocks in the first plurality of blocks that correspond to each block of a matched region of the second image to the set of one or more electronic devices.

Another embodiment of the first aspect further comprises sending the first image to the set of one or more electronic devices after every block of the second image are sent to the set of electronic devices.

In another embodiment of the first aspect, each side of a cube puzzle has a same plurality of rows and columns, wherein grouping the second plurality of blocks into the plurality of regions comprises grouping the second plurality of blocks into regions that have a same plurality of rows and columns as a side of a cube puzzle Another embodiment of the first aspect further comprises giving points or assigning prizes to persons operating the cube puzzles based on a speed at which a region is matched by a cube puzzle or a number of regions matched by a cube puzzle.

In another embodiment of the first aspect, receiving the indication that the colors of the blocks on the side of the cube puzzle associated with the electronic device are matched to the colors of the blocks of the region assigned to the cube puzzle comprises: receiving an image of a side of the cube puzzle that is matched to the colors of the blocks of the assigned region by the computing device from the electronic device associated with the cube puzzle; and analyzing the image by the computing device to determine that the colors of the blocks on the side of the cube puzzle are matched to the colors of the blocks of the assigned region.

In another embodiment of the first aspect, receiving the indication that the colors of the blocks on the side of the cube puzzle associated with the electronic device are matched to the colors of the blocks of the region assigned to the cube puzzle comprises receiving a message from a proctor indicating that the side of the cube puzzle is matched to the colors of the blocks of the assigned region.

Another embodiment of the first aspect further comprises: starting a timer; and sending the colors of the blocks of a set of one or more regions and a location of the one or more regions in the second image from the computing device to the set of electronic devices after an expiration of the timer even if the colors of the blocks of the set of one or more regions are not matched on the side of any cube puzzles.

In a second aspect, a non-transitory computer-readable medium storing a program for gradually revealing images by a computing device to a set of one or more electronic devices is provided. Each electronic device is associated with a cube puzzle, each cube puzzle has six sides, each side comprising a plurality of blocks, each block of the cube puzzles comprises one of a plurality of six colors, the program executable by a processor of the computing device. The program comprises sets of instructions for: dividing a first image into a first plurality of blocks, each block in the first plurality of blocks comprising a set of one or more colors; generating the first image into a second image, the second image comprising a second plurality of blocks, each block in the second plurality of blocks corresponding to a set of one or more blocks in the first plurality of blocks, each block in the second plurality of blocks being a unicolor block comprising one color from the plurality of six colors of the cube puzzles' blocks; grouping the second plurality of blocks into a plurality of regions, each region comprising a same number of blocks as the plurality of blocks of a side of a cube puzzle; assigning one or more regions of the second image to each cube puzzle; sending the colors of the blocks of each region to the electronic devices associated with the cube puzzles to which the regions are assigned; receiving an indication that the colors of the blocks on a side of the cube puzzle associated with the electronic device are matched to the colors of the blocks of the region assigned to the cube puzzle; sending the colors of the blocks of the matched region and a location of the matched region in the second image to the set of electronic devices; and repeating the receiving of an indication from an electronic device in the set of electronic devices and the sending of the colors of the blocks of a matched region and a location of the matched region a plurality of times to reveal at least a portion of the second image to the set of electronic devices.

In an embodiment of the second aspect, each of the first and second images comprises a plurality of pixels, each pixel has a color, and the set of instructions for generating the first image into the second image comprises a set of instructions for generating each pixel of the first image having an arbitrary color into a corresponding pixel of the second image having one of the plurality of colors of six colors of the cube puzzles' blocks.

In another embodiment of the second aspect, each of the first and second images comprises a plurality of pixels, each pixel has a color, and the set of instructions for generating the first image into the second image comprises a set of instructions for mapping each of a plurality of the pixels of the first image having arbitrary colors into one pixel of the second image having one of the plurality of colors of six colors of the cube puzzles' blocks.

An embodiment of the second aspect further comprises a set of instructions for assigning one or more additional regions of the second image to a cube puzzle after the colors of the blocks on a side of the cube puzzle are matched to the colors of the blocks of the region assigned to the cube puzzle.

Another embodiment of the second aspect further comprises a set of instructions for sending the one or more blocks in the first plurality of blocks that correspond to each block of a matched region of the second image to the set of one or more electronic devices.

Another embodiment of the second aspect further comprises a set of instructions for sending the first image to the set of one or more electronic devices after every block of the second image are sent to the set of electronic devices.

In another embodiment of the second aspect, each side of a cube puzzle has a same plurality of rows and columns, wherein the set of instructions for grouping the second plurality of blocks into the plurality of regions comprises a set of instructions for grouping the second plurality of blocks into regions that have a same plurality of rows and columns as a side of a cube puzzle.

Another embodiment of the second aspect further comprises a set of instructions for giving points or assigning prizes to persons operating the cube puzzles based on a speed at which a region is matched by a cube puzzle or a number of regions matched by a cube puzzle.

In another embodiment of the second aspect, the set of instructions for receiving the indication that the colors of the blocks on the side of the cube puzzle associated with the electronic device are matched to the colors of the blocks of the region assigned to the cube puzzle comprises sets of instructions for: receiving an image of a side of the cube puzzle that is matched to the colors of the blocks of the assigned region by the computing device from the electronic device associated with the cube puzzle; and analyzing the image by the computing device to determine that the colors of the blocks on the side of the cube puzzle are matched to the colors of the blocks of the assigned region.

In another embodiment of the second aspect, the set of instructions for receiving the indication that the colors of the blocks on the side of the cube puzzle associated with the electronic device are matched to the colors of the blocks of the region assigned to the cube puzzle comprises a set of instructions for receiving a message from a proctor indicating that the side of the cube puzzle is matched to the colors of the blocks of the assigned region.

Another embodiment of the second aspect further comprises comprising sets of instructions for: starting a timer; and sending the colors of the blocks of a set of one or more regions and a location of the one or more regions in the second image from the computing device to the set of electronic devices after an expiration of the timer even if the colors of the blocks of the set of one or more regions are not matched on the side of any cube puzzles.

The above description presents the best mode contemplated for carrying out the present embodiments, and of the manner and process of practicing them, in such full, clear, concise, and exact terms as to enable any person skilled in the art to which they pertain to practice these embodiments. The present embodiments are, however, susceptible to modifications and alternate constructions from those discussed above that are fully equivalent. Consequently, the present invention is not limited to the particular embodiments disclosed. On the contrary, the present invention covers all modifications and alternate constructions coming within the spirit and scope of the present disclosure. For example, the steps in the processes described herein need not be performed in the same order as they have been presented, and may be performed in any order(s). Further, steps that have been presented as being performed separately may in alternative embodiments be performed concurrently. Likewise, steps that have been presented as being performed concurrently may in alternative embodiments be performed separately.

What is claimed is:

1. An automated method of gradually revealing images by a computing device to a set of one or more electronic devices, each electronic device associated with a cube puzzle, each cube puzzle having six sides, each side comprising a plurality of blocks, each block of the cube puzzles comprising one of a plurality of six colors, the method comprising:

dividing a first image into a first plurality of blocks, each block in the first plurality of blocks comprising a set of one or more colors;

generating a second image from the first image by the computing device, the second image comprising a second plurality of blocks, each block in the second plurality of blocks corresponding to a set of one or more blocks in the first plurality of blocks, each block in the second plurality of blocks being a unicolor block comprising one color from the plurality of six colors of the cube puzzles' blocks;

grouping the second plurality of blocks into a plurality of regions by the computing device, each region comprising a same number of blocks as the plurality of blocks of a side of a cube puzzle;

assigning one or more regions of the second image to each cube puzzle;

sending the colors of the blocks of each region, from the computing device, to the electronic devices associated with the cube puzzles to which the regions are assigned;

receiving an indication, by the computing device, that the colors of the blocks on a side of the cube puzzle associated with the electronic device are matched to the colors of the blocks of the region assigned to the cube puzzle;

sending the colors of the blocks of the matched region and a location of the matched region in the second image from the computing device to the set of electronic devices; and repeating the receiving of an indication from an electronic device in the set of electronic devices and the sending of the colors of the blocks of a matched region and a location of the matched region a plurality of times to reveal at least a portion of the second image to the set of electronic devices.

2. The automated method of claim 1, wherein each of the first and second images comprises a plurality of pixels, wherein each pixel has a color, wherein generating the first image into the second image comprises generating each pixel of the first image having an arbitrary color into a corresponding pixel of the second image having one of the plurality of colors of six colors of the cube puzzles' blocks.

3. The automated method of claim 1, wherein each of the first and second images comprises a plurality of pixels, wherein each pixel has a color, wherein generating the first image into the second image comprises mapping each of a plurality of the pixels of the first image having arbitrary colors into one pixel of the second image having one of the plurality of colors of six colors of the cube puzzles' blocks.

4. The automated method of claim 1 further comprising assigning one or more additional regions of the second image to a cube puzzle after the colors of the blocks on a side of the cube puzzle are matched to the colors of the blocks of the region assigned to the cube puzzle.

5. The automated method of claim 1 further comprising sending the one or more blocks in the first plurality of blocks that correspond to each block of a matched region of the second image to the set of one or more electronic devices.

6. The automated method of claim 1 further comprising sending the first image to the set of one or more electronic devices after every block of the second image are sent to the set of electronic devices.

7. The automated method of claim 1, wherein each side of a cube puzzle has a same plurality of rows and columns, wherein grouping the second plurality of blocks into the plurality of regions comprises grouping the second plurality of blocks into regions that have a same plurality of rows and columns as a side of a cube puzzle.

8. The automated method of claim 1, wherein receiving the indication that the colors of the blocks on the side of the cube puzzle associated with the electronic device are matched to the colors of the blocks of the region assigned to the cube puzzle comprises:

receiving an image of a side of the cube puzzle that is matched to the colors of the blocks of the assigned region by the computing device from the electronic device associated with the cube puzzle; and analyzing the image by the computing device to determine that the colors of the blocks on the side of the cube puzzle are matched to the colors of the blocks of the assigned region.

9. The automated method of claim 1, wherein receiving the indication that the colors of the blocks on the side of the cube puzzle associated with the electronic device are matched to the colors of the blocks of the region assigned to the cube puzzle comprises receiving a message from a proctor indicating that the side of the cube puzzle is matched to the colors of the blocks of the assigned region.

10. The automated method of claim 1 further comprising:

starting a timer; and sending the colors of the blocks of a set of one or more regions and a location of the one or more regions in the second image from the computing device to the set of electronic devices after an expiration of the timer even if the colors of the blocks of the set of one or more regions are not matched on the side of any cube puzzles.

11. A non-transitory computer-readable medium storing a program for gradually revealing images by a computing device to a set of one or more electronic devices, each electronic device associated with a cube puzzle, each cube puzzle having six sides, each side comprising a plurality of blocks, each block of the cube puzzles comprising one of a plurality of six colors, the program executable by a processor of the computing device, the program comprising sets of instructions for:

dividing a first image into a first plurality of blocks, each block in the first plurality of blocks comprising a set of one or more colors;

generating the first image into a second image, the second image comprising a second plurality of blocks, each block in the second plurality of blocks corresponding to a set of one or more blocks in the first plurality of blocks, each block in the second plurality of blocks being a unicolor block comprising one color from the plurality of six colors of the cube puzzles' blocks;

grouping the second plurality of blocks into a plurality of regions, each region comprising a same number of blocks as the plurality of blocks of a side of a cube puzzle;

assigning one or more regions of the second image to each cube puzzle;

sending the colors of the blocks of each region to the electronic devices associated with the cube puzzles to which the regions are assigned;

receiving an indication that the colors of the blocks on a side of the cube puzzle associated with the electronic device are matched to the colors of the blocks of the region assigned to the cube puzzle;

sending the colors of the blocks of the matched region and a location of the matched region in the second image to the set of electronic devices; and repeating the receiving of an indication from an electronic device in the set of electronic devices and the sending of the colors of the blocks of a matched region and a location of the matched region a plurality of times to reveal at least a portion of the second image to the set of electronic devices.

12. The non-transitory computer-readable medium of claim 11, wherein each of the first and second images comprises a plurality of pixels, wherein each pixel has a color, wherein the set of instructions for generating the first image into the second image comprises a set of instructions for generating each pixel of the first image having an arbitrary color into a corresponding pixel of the second image having one of the plurality of colors of six colors of the cube puzzles' blocks.

13. The non-transitory computer-readable medium of claim 11, wherein each of the first and second images comprises a plurality of pixels, wherein each pixel has a color, wherein the set of instructions for generating the first image into the second image comprises a set of instructions for mapping each of a plurality of the pixels of the first image having arbitrary colors into one pixel of the second image having one of the plurality of colors of six colors of the cube puzzles' blocks.

14. The non-transitory computer-readable medium of claim 11, the program further comprising a set of instructions for assigning one or more additional regions of the second image to a cube puzzle after the colors of the blocks on a side of the cube puzzle are matched to the colors of the blocks of the region assigned to the cube puzzle.

15. The non-transitory computer-readable medium of claim 11, the program further comprising a set of instructions for sending the one or more blocks in the first plurality of blocks that correspond to each block of a matched region of the second image to the set of one or more electronic devices.

16. The non-transitory computer-readable medium of claim 11, the program further comprising a set of instructions for sending the first image to the set of one or more electronic devices after every block of the second image are sent to the set of electronic devices.

17. The non-transitory computer-readable medium of claim 11, wherein each side of a cube puzzle has a same plurality of rows and columns, wherein the set of instructions for grouping the second plurality of blocks into the plurality of regions comprises a set of instructions for grouping the second plurality of blocks into regions that have a same plurality of rows and columns as a side of a cube puzzle.

18. The non-transitory computer-readable medium of claim 11, wherein the set of instructions for receiving the indication that the colors of the blocks on the side of the cube puzzle associated with the electronic device are matched to the colors of the blocks of the region assigned to the cube puzzle comprises sets of instructions for:

receiving an image of a side of the cube puzzle that is matched to the colors of the blocks of the assigned region by the computing device from the electronic device associated with the cube puzzle; and analyzing the image by the computing device to determine that the colors of the blocks on the side of the cube puzzle are matched to the colors of the blocks of the assigned region.

19. The non-transitory computer-readable medium of claim 11, wherein the set of instructions for receiving the indication that the colors of the blocks on the side of the cube puzzle associated with the electronic device are matched to the colors of the blocks of the region assigned to the cube puzzle comprises a set of instructions for receiving a message from a proctor indicating that the side of the cube puzzle is matched to the colors of the blocks of the assigned region.

20. The non-transitory computer-readable medium of claim 11, the program further comprising sets of instructions for:

starting a timer; and sending the colors of the blocks of a set of one or more regions and a location of the one or more regions in the second image from the computing device to the set of electronic devices after an expiration of the timer even if the colors of the blocks of the set of one or more regions are not matched on the side of any cube puzzles.

* * * * *